United States Patent [19]

Crepinsek

[11] Patent Number: 4,639,024

[45] Date of Patent: Jan. 27, 1987

[54] SIMULTANEOUSLY OPERATED DEAD BOLT LOCK AND SECURITY CHAIN

[76] Inventor: Alois Crepinsek, 97 N. Arizona Pl., Chandler, Ariz. 85224

[21] Appl. No.: 557,907

[22] Filed: Dec. 5, 1983

[51] Int. Cl.[4] ..... E05C 17/36

[52] U.S. Cl. ..... 292/264; 292/DIG. 53; 292/337; 70/93

[58] Field of Search ..... 292/264, 337, DIG. 53, 292/244, 245; 70/93

[56] References Cited

U.S. PATENT DOCUMENTS

| | | | |
|---|---|---|---|
| 2,508,702 | 5/1950 | Baumé | 292/337 X |
| 3,031,220 | 4/1962 | Reiss | 292/337 X |
| 3,897,966 | 8/1975 | Draughon, Sr. | 292/264 |
| 4,027,907 | 6/1977 | Crepinsek | 292/264 |

*Primary Examiner*—Richard E. Moore

*Attorney, Agent, or Firm*—James F. Duffy; Robert A. Hirschfeld

[57] ABSTRACT

A dead bolt lock houses both a dead bolt and a security chain assembly. Externally accessible drive linkages cause the simultaneous ejection of the dead bolt and a portion of the security chain assembly whereby the dead bolt is engaged with a strike plate in the door jamb and the security chain assembly is latched to a chain latch assembly which forms a part of the strike plate. Operation of the externally accessible drive linkage to withdraw the dead bolt back into the lock is achieved without disengagement of the security chain assembly from the jamb mounted latch. A separate latch release is provided for disengaging the security chain. The lock body is provided with door penetrating detents which are actuated by the insertion of the dead bolt within the lock body whereby the detents are raised from within the lock body so as to lockingly engage with the door. No exterior screw fastenings are available to be tampered with, the lock body is enclosed within the door by the combination of exterior and interior plates and a latch plate. The door itself forms the remaining sides of the enclosure.

14 Claims, 8 Drawing Figures

SIMULTANEOUSLY OPERATED DEAD BOLT LOCK AND SECURITY CHAIN

RELATED APPLICATIONS

A strike plate with orthogonal, in jamb, coupling members is disclosed in the inventor's applications (A) No. 411,443, filed 8/25/82, now U.S. Pat. No. 4,474,394, issued Oct. 2, 1984; (B) No. 411,687, filed 8/26/82, now U.S. Pat. No. 4,577,896, issued Mar. 25, 1986; and (C) No. 460,273, filed 1/24/83, now U.S. Pat. No. 4,580,819, issued Apr. 8, 1986. Applications (B) and (C) further disclose a flush mounted, pivoted chain latch housing integral with said strike plate. Application (C) also discloses a security chain assembly housed within a lock body.

BACKGROUND

1. Field of the Invention

The invention relates to dead bolt locks and security chains.

The invention particularly relates to a dead bolt lock housing a security chain assembly therein.

The invention specifically relates to a simultaneously actuated dead bolt lock and security chain assembly wherein the security chain is actuated to its latched conditiuon.

2. Prior Art

Many doors are secured by means of a key actuated tumbler lock. For added security, persons frequently add a second, manually operated dead bolt lock to their door. Such installations are frequently found in hotels and motels which cater primarily to transient trade. A third security installation often includes the addition of a security chain which couples the door to the door jamb such that the door may be placed slightly ajar to permit the person within the room, secured by the security chain, to view a person or persons desiring entry. The dangling security chain is unattractive at best and frequently mars the finish of the door as it hangs from its anchored end and moves in pendulum fashion against the door finish. Frequently, too, a person will inadvertently open the door without having secured it first with the security chain. This leaves such persons unprotected once the door locks have been opened and the door placed ajar.

It is an objective of the present invention to provide a dead bolt lock which has a security chain assembly housed therein such that the security chain assembly will not detract from the finished appearance of the door in which the lock is installed.

It is a further objective of the invention to provide a dead bolt lock having a security chain housed therein and including means whereby the throwing of the dead lock simultaneously results in the ejection of a portion of the security chain and the automatic latching of the security chain to the door jamb.

It is another objective of the invention to provide a dead bolt lock having door penetrating detents capable of the lock in place within a door even when the external mounting hardware has been removed.

SUMMARY OF THE INVENTION

The invention is a dead bolt lock having an internally housed security chain which is simultaneously ejected with the dead bolt. The lock comprises a dead bolt lock which has a dead bolt and a self-retracting security chain assembly housed therein. A security chain drive linkage means, also housed within the dead bolt lock, is employed for partially ejecting a portion of the security chain assembly from the dead bolt lock when an externally accessible drive means, which is coupled to both the security drive linkage means and the dead bolt, is actuated. Actuation of the externally accessible drive means simultaneously ejects a portion of the dead bolt and a portion of the security chain assembly from the dead bolt lock.

In a presently preferred embodiment, the dead bolt lock further comprises door penetrating detents which are activated by the dead bolt to penetrate the door in which the lock is installed.

The invention may be seen to comprise an improvement in a dead bolt lock which lock comprises a lock body having a dead bolt means therein, a lock housing for housing the lock body and coupling same within the door to be secured and means for exercising the dead bolt so as to eject and retract the dead bolt from the lock body. The improvement comprises a security chain assembly coupled to the lock body and housed within the lock housing for mounting within the door with the body. Security chain ejection means are coupled to means for exercising the dead bolt so as to simultaneously eject the dead bolt and a portion of the security chain assembly from the lock housing when the exercising means is actuated to eject the dead bolt from the lock body.

The security chain assembly comprises a security chain, and a latch hook coupled to a first end of the security chain for retaining a retracting tension on the security chain.

The retraction means comprises spring means having a first end coupled to the lock body and retraction linkage means for coupling a second end of the spring means to a second end of the security chain. The retraction linkage means further comprises a stop-pawl. The lock body and the lock housing are provided with stop-pawl guideways for guiding and positively limiting the extent of travel of the stop-pawl. The extent of egress of the security chain from the lock housing is thus also limited.

As earlier noted door penetrating detents are coupled to the lock body and actuated by the dead bolt means that penetrate a door to which the dead bolt lock is installed.

The dead bolt lock and the improvements to such lock further comprise, in combination therewith, chain latch means for latchedly engaging and retaining a portion of the security chain assembly ejected from the dead lock by actuation of the externally accessible drive means. The chain latch means is meant to be installed within a door jamb adjacent to the dead bolt lock when the lock is installed in the door.

The chain latch means is disclosed as comprising a strike plate and a latch housing recessed within the strike plate and pivotally coupled thereto. The strike plate further comprises orthogonal coupling means to be matingly coupled within a door jamb in which the chain latch means is installed. These orthogonal coupling means thereby retain the chain latch means within the door jamb.

DETAILS OF THE INVENTION

Figure 1:
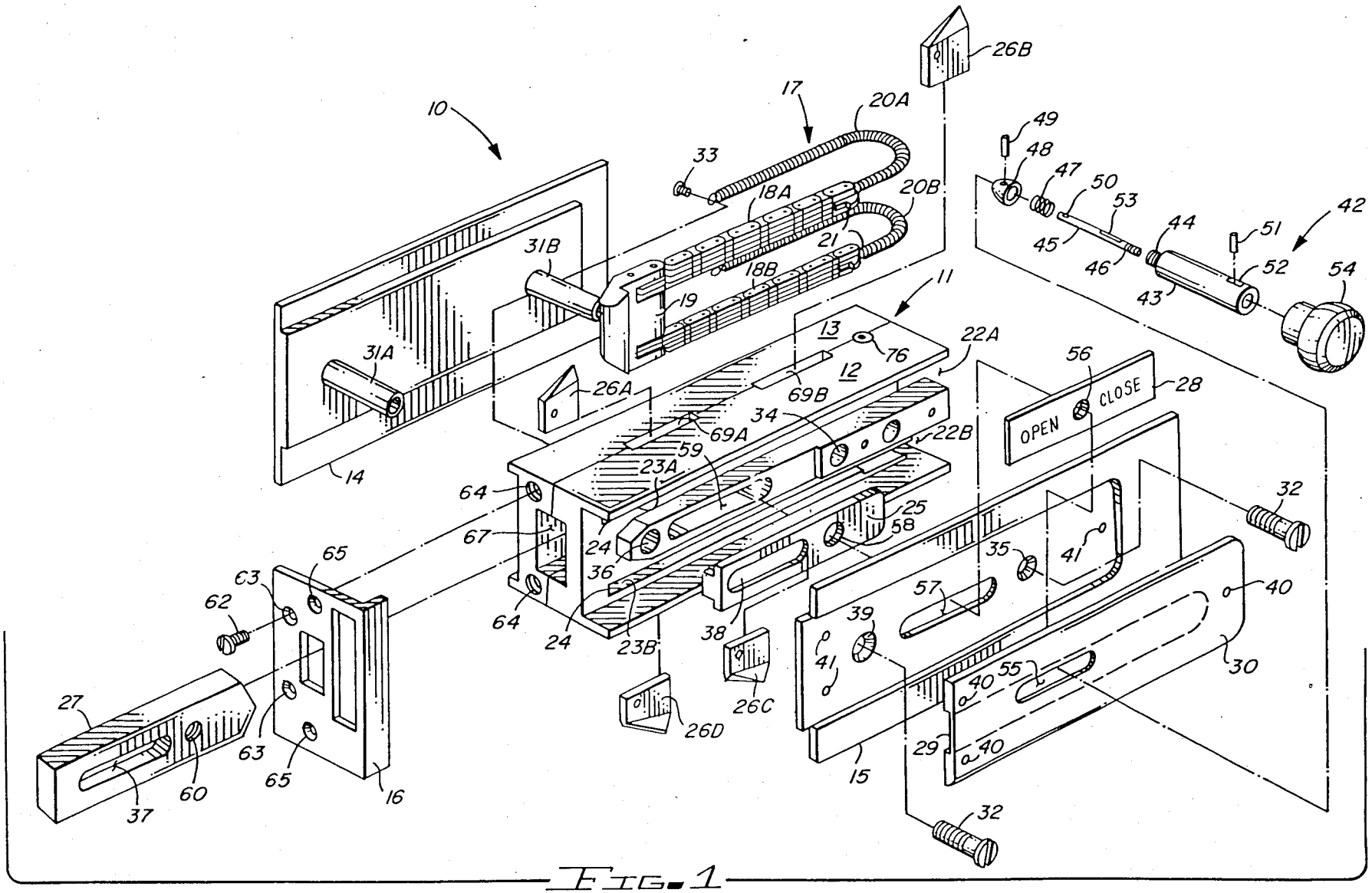
FIG. 1 is an exploded perspective drawing of the dead bolt/security chain lock assembly.

For the purposes of promoting an understanding of the principles of the invention, reference will now be made to the embodiment illustrated in the drawings. Specific language will be used to describe the same. It will, nevertheless, be understood that no limitation of the scope of the invention is thereby intended; such alterations and further modifications in the illustrated device, and such further applications of the principles of the invention as illustrated herein being contemplated as would normally occur to one skilled in the art to which the invention relates.

Figure 5:
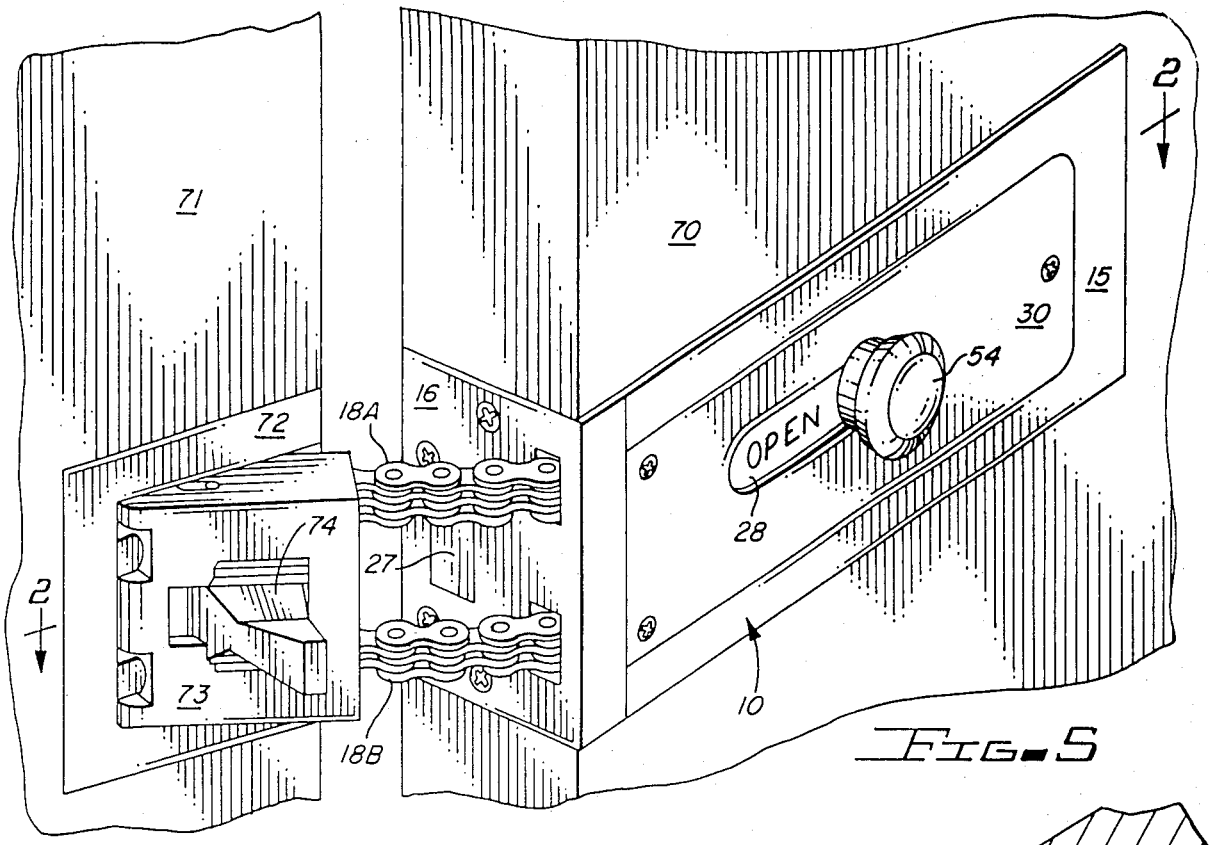
FIG. 5 is a perspective drawing showing the lock installed in a door and the security chain engaged with a chain latch in the door jamb.

An exploded assembly drawing of a dead bolt lock having means for simultaneously ejecting a security chain at the same time as the dead bolt is thrown is illustrated in FIG. 1. The assembled lock installed in the door is illustrated in FIG. 5.

With respect to FIG. 1, the dead bolt, chain latch lock assembly is designated by the general reference 10. The lock is comprised of a lock body 11 made up of two body-halves 12 and 13. Exterior plates 14 and 15 and latch plate 16 provide a three-sided housing for lock body 11. When installed within a door, the door completes the enclosure.

Housed within lock body 11 is security chain assembly 17 which is comprised of a pair of security chains 18A and 18B and a latch hook 19. Springs 20A and 20B are coupled to chains 18 by means of stop-pawl linkages 21. As more clearly seen in FIG. 6, stop-pawl linkages 21 are double ended having stop-pawls at the enterior and exterior sides of chains 18. Lock body-half 12 is provided with chain guideways 22A and 22B for guiding the passage of security chains 18A and 18B respectively. Also provided within lock body-half 12 are stop-pawl guideways 23A and 23B for guiding the rearmost pawls of stop-pawl linkages 21. The assembly of plate 15 to lock body 11 will provide a second stop-pawl guideway for the guidance of the exterior pawl of stop-pawl linkages 21. The ends 24 of stop-pawl guideways 23 provide positive stops for limiting the travel of stop-pawl linkages 21 and thus limit the extent to which security chains 18 may be withdrawn from lock body 11.

Pivoting door penetrating detents 26 are housed within slots 69 of lock body 11. When lock body 11 is placed within a door, the introduction of dead bolt 27 into dead bolt guideway 67 of body 11 causes door penetrating detents 26 to rise from slots 69 and penetrate the door in which the lock is installed.

A security chain drive link 25 is actuated when dead bolt 27 is thrown so as to cause the ejection of a portion of security chain assembly 17 from lock body 11 simultaneous with the throwing of dead bolt 27.

An escutcheon plate 30 is implaced withih a recess in plate 15 to conceal the assembly hardware 32. Escutcheon plate 30 is provided with a recess 29 for slidingly captivating status plate 28 which provides a visual indication of the status of dead bolt 27, which status is viewable through slot 55 in escutcheon plate 30. The status of dead bolt 27 is indicated on status plate 28 by the words "open" and "closed".

A chain/bolt drive rod assembly 42 is provided for actuation of dead bolt 27 and simultaneous ejection of security chain latch hook 19 and a portion of security chains 18 when dead bolt 27 is thrown.

Chain/bolt rod assembly 42 comprises a hollow shaft 43 which is threaded at one end 44. The opposite end of shaft 43 fits within a recess in knob 54. A detent rod 45 is passed through hollow shaft 43 and threadedly engaged with knob 54 by means of threads 46 and a threaded opening (not shown) within knob 54. A pin 51 passing through slot 52 and hollow shaft 43 and slot 53 in detent rod 45 allows a limited slide action of detent rod 45 within hollow shaft 43. A spring 47 is passed over the end of detent rod 45 which protrudes from hollow shaft 43 and is retained thereon by coupling detent anvil 48 to detent rod 45 by means of pin 49 which passes through detent anvil 48 and hole 50 in detent rod 45. Spring 47 acts to draw detent anvil 48 away from hollow shaft 43 while drawing knob 54 into more intimate contact with hollow rod 43.

The assembly of dead bolt lock 10 proceeds as follows. Security chain assembly 17 is coupled to lock body 11 by introducing chains 18A and 18B into guideways 22A and 22B respectively. The anterior stop-pawls of stop-pawl linkages 27 are introduced simultaneously into guideways 23A and 23B of body-half 12. Springs 20A and 20B are drawn around lock body 11 with the extreme ends of the springs being coupled to body-half 13 by means of screw fasteners such as 33. The passage of springs 20 about lock body 11 is eased by means of bearings 75, best seen in FIG. 6, which are pivotally mounted to lock body 11 by means of axle shaft 76.

A cut-out is provided in a door 70 to accept lock body 11. Lock body 11 is implaced within the cut-out in the door 70 and dead bolt 27 is injected into dead bolt guideway 67 thereby raising door penetrating detents 26 so as to penetrate door 70.

Figure 4A:
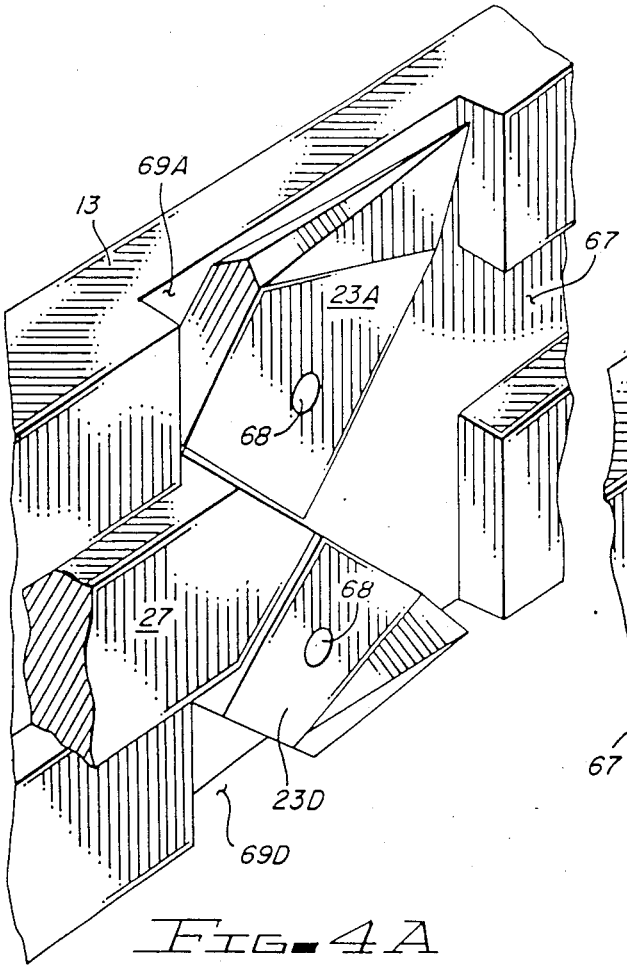
FIGS. 4A and 4B are perspective drawings illustrating the manner in which the lock dead bolt raises the door penetrating detents to engage with the door in which the lock is installed.
Figure 4B:
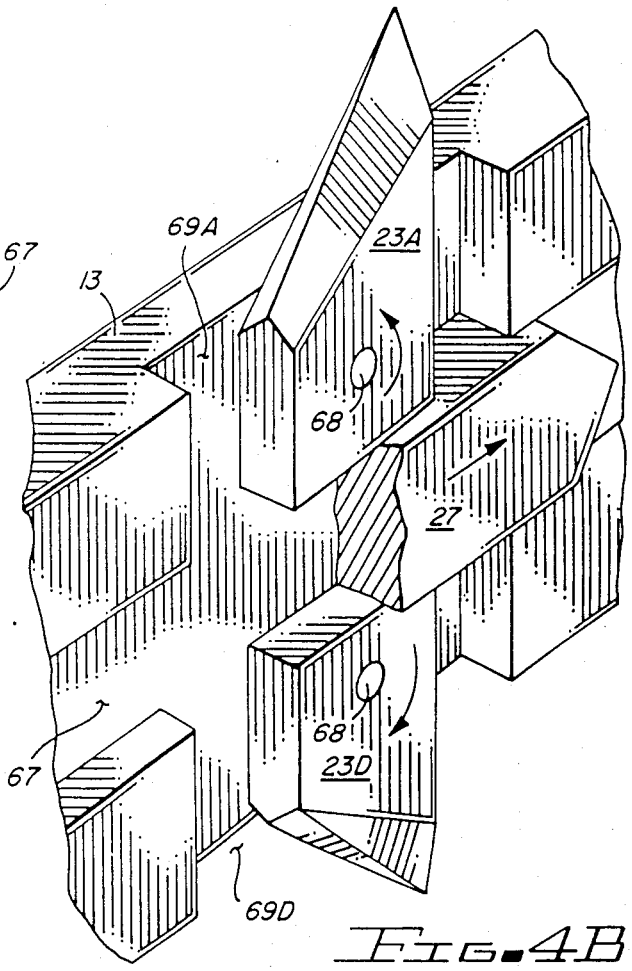

A reference may here be made to FIGS. 4A and 4B which illustrate the action of dead bolt 27 in raising door penetrating detents 23 so as to penetrate the door in which lock body 11 is to be installed. In these Figures, only body-half 13 is illustrated for the sake of clarity. In FIG. 4A, door penetrating detents 23A and 23D are illustrated being coupled to body-half 13 by means of pivot pins 68. Door penetrating detents 23 are illustrated in their nominal position prior to being raised so as to penetrate the door in which lock body 11 is installed. The effect of injecting dead bolt 27 into dead bolt guideway 67 is illustrated in FIG. 4B. The passage of dead bolt 27 through guideway 67 causes detents 23 to pivot about pivot pins 68 and thereby be raised above slots 69 so as to penetrate into the door surfaces immediately above and below lock body 11. Detents 26 are most clearly illustrated in their raised position penetrating door 70 in FIG. 7.

With lock body 11 mounted in the cut-out of door 70 and dead bolt 27 inserted within guideway 67 so as to raise door penetrating detents 26 so as to engage the detents with door 27, the installation proceeds as follows. Chain drive linkage 25 is implaced between chains 18A and 18B such that slot 38 of link 25 is aligned with opening 36 in body-half 12 while hole 58 of link 25 is aligned with the slot 59 in body-half 12.

Exterior plate 14 is next installed. Exterior plate 14 is provided with two internally threaded alignment rods 31. Alignment rod 31B passes through openings 34 in body-halves and 13 of body 11 and will align with opening 35 in interior plate 15 when that plate is installed. Alignment rod 31A passes through a first opening 36 (not shown) in body-half 13, thence through slot 37 in dead bolt 27, and proceeds through a second opening 36 in body-half 12 from whence it continues through slot 38 in drive linkage 25 where it will align with opening 39 in plate 15 when that plate is installed.

Plate 15 is now installed on the interior side of the door by passage of screw fasteners 32 through openings 35 and 39 in plate 15. Screw fasteners 32 threadedly couple to the internal threaded openings of aligned rods 31.

Status plate 28 is now introduced into the recess 29 in the rear of escutcheon plate 30. Escutcheon plate 30 is then implaced within the recess in plate 15 and fastened there by means of small decorative screw fasteners (not shown) which pass through holes 40 in escutcheon plate 30 to mate with threaded holes 41 in plate 15.

Figure 7:
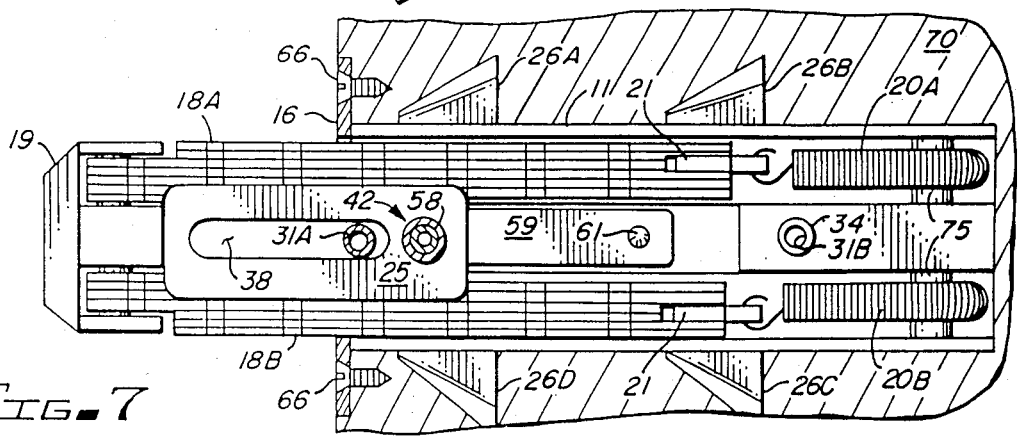
FIG. 7 is a sectional elevation showing the manner in which the security chain is activated for latching and the engagement of the door penetrating detents with the door in which the lock is installed.

The chain bolt drive assembly 42 is now installed by passing detent anvil 49 through slot 55 in escutcheon plate 30, opening 56 in status plate 28, slot 57 in interior plate 15, opening 58 in chain drive linkage 25, slot 59 in body-half 12, and threaded hole 60 in dead bolt 27 from whence it emerges to mate with one of two detent holes 61 in the interior wall of body half 13. One of the two detent holes 61 is illustrated in FIG. 7. Rotation of knob 54 in a clockwise direction, will cause the threaded end 44 of hollow shaft 43 to engage with the threads within threaded hole 60 in dead bolt 27 thus retaining chain/-bolt drive rod assembly 42 in position on lock 10.

Figure 2:
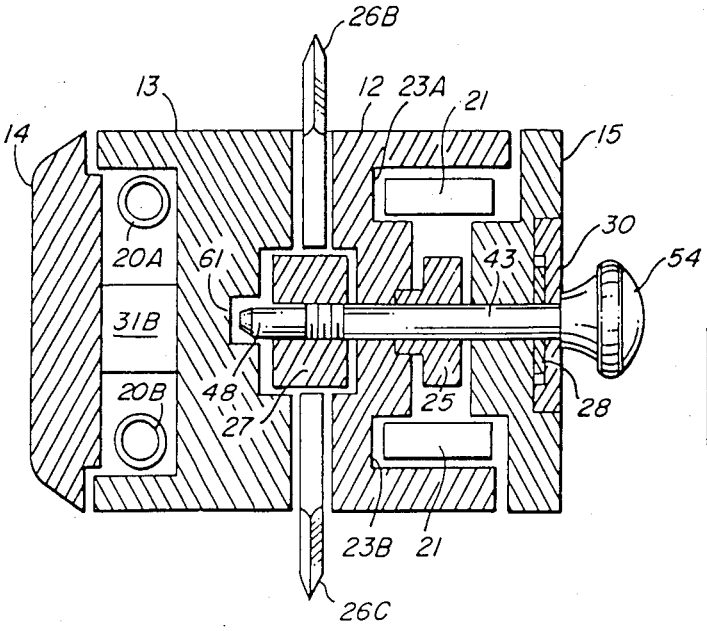
FIG. 2 is a section view of the assembled lock showing the relationship of certain elements therein.

FIG. 2 is a cross sectional view showing the relationship of various components of lock 10 after the lock has been installed within the door and assembled in the manner herein just disclosed.

Latch plate 16 is now affixed to lock body 11 by means of screw fasteners 62 which pass through holes 63 in latch plate 16 to engage both threaded openings 64 in body-half 13. Wood screws (not shown) are passed through openings 65 in latch plate 16 to engage with the door 70 in which lock 10 is installed. Upon completion of the steps, lock 10 has been installed and assembled within door 7.

Figure 3:
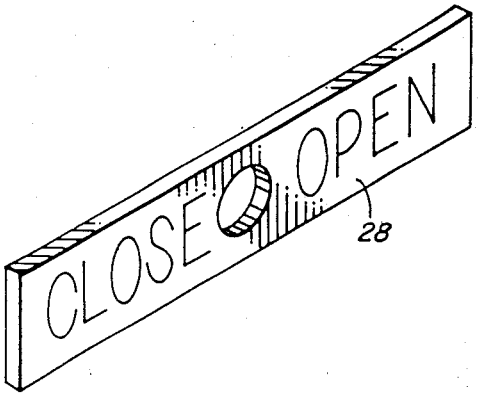
FIG. 3 is the reverse side of the lock status plate. Imprinting on both sides permits installation of the the lock on right or left side opening doors.

The installation of lock 10 to a door which is hinged either to the left or the right side of the door is accomplished by an appropriate rotation of lock body 11 one hundred eighty degrees about its longitudinal axis. To accomodate lock 10 for installation in doors hinged on either side, status plate 28 is imprinted on both sides and is reversable so that the appropriate status imprinting may be viewed through slot 55 of escutcheon plate 30. The imprinting on status plate 28 of FIG. 3 is that which appears on the reverse side of the status plate 28 illustrated in FIG. 1.

In the installation of lock 10 and door 70 of FIG. 1, lock 10 is shown in combination with a chain latch means comprised of a strike plate 72, chain latch housing 73 and chain latch 74. Chain latch housing 73 is pivotally coupled to strike plate 72 by means of axle pin 79, FIG. 6. As shown most clearly in the top sectional view of FIG. 6, strike plate 72 is coupled to the door jamb by orthogonal coupling means comprised of post 77 and screw fastener 78. The orthogonal mating of post 77 and screw fastener 78 within the confines of door jamb 71 provides an extremely sturdy mounting of strike plate 72 to door jamb 71. Axle pin 79 couples chain latch housing to each of a pair of posts 77 so that housing 73 may pivot outwardly away from the door jamb when chain latch hook 19 is engaged with latch 74 and the door 70 is open. Chain latch means comprising similar strike plates and chain latch housings are described in the inventor's earlier applications; Ser. No. 411,687, filed Aug. 26, 1982, and now U.S. Pat. No. 4,577,896 issued Mar. 25, 1986; and Ser. No. 460,273 filed Jan. 24, 1983, and now U.S. Pat. No. 4,580,819 issued Mar. 8, 1986.

Figure 6:
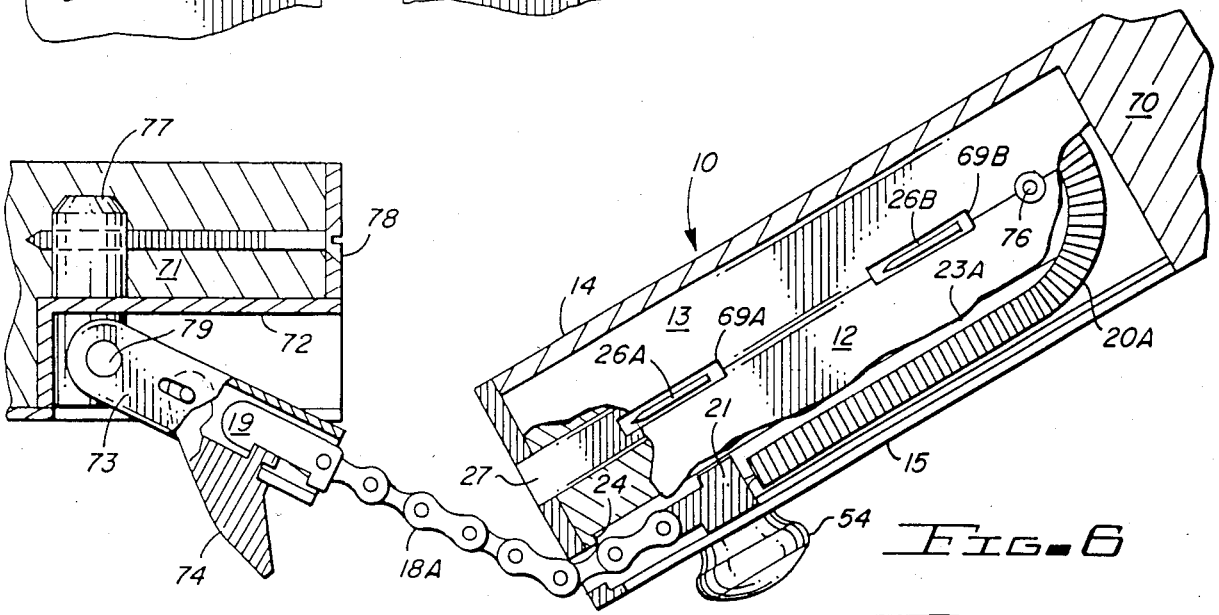
FIG. 6 is a top sectional view of the lock installation of FIG. 5.

As may be seen in the top sectional view of FIG. 6, the chain may be extended by the opening of door 70 only to the extent of travel of stop-pawl 21 within guideway 23A. When stop-pawl 21 is brought into interfering contact with the end 24 of guideway 23A, further movement of the chain and thus further opening of the door is inhibited. When the door is again closed, springs 20 retract security chains 18 back into the body of lock 10.

The manner in which security chain 18 and latch hook 19 is ejected from lock body 11 is best seen with reference to the side sectional view of FIG. 7. However, reference should also be made to FIG. 1 at this time. It will be noted that hollow shaft 43 of chain/bolt drive rod assembly 42 passes through opening 58 in chain drive link 25 and is threadedly fastened to opening 60 in dead bolt 27. Thus the slot 38 in chain drive link 25 is aligned with the slot 37 in dead bolt 27 and the drive rod assembly 42 actuates both chain drive link 25 and dead bolt 27 simultaneously. The extent of travel of the drive rod assembly 42 is limited by the length of slot 59 in body 12. The slot 38 in drive link 25 and the slot 37 in dead bolt 27 are provided to allow movement of these elements without interference with alignment rod 31A which passes through both slots 37 and 38.

In FIG. 7 it is seen that the drive rod assembly 42, passing through opening 58 and chain drive link 25 has been moved so as to translate drive rod link 25 to the left-most extent of travel of drive rod assembly 42 as limited by the length of slot 59. Movement of chain and drive link 25 to the left as shown extends latch hook 19 and a portion of chains 18 outside of a lock body 11. At the same time, dead bolt 27 has also been extended so as to engage in a conventional manner with strike plate 72. The extension of latch hook 19 causes its engagement with latch 74 in latch housing 73.

In these circumstances the imprinting on status plate 28 as viewed through slot 55 of escutcheon plate 30 will indicate that the dead bolt 27 is in the "closed" position. When drive rod assembly 42 is moved back to the right of the illustration of FIG. 7, chain drive link 25 and dead bolt 27 will be simultaneously moved to the right of the illustration of FIG. 7. However, spring 20, in attempting to retract chains 18 back into body 11, will cause a locking engagement of latch 74 with chain latch housing 73 and prevent the disengagement of latch hook 19 from latch 74. Thus, when the dead bolt is withdrawn, the security chain latch hook 19 remains engaged with latch 74 and the door may then be opened with a modicum of safety provided by the security chain 18 so that the occupant of the secured room may have a view of a person seeking entrance. When the door is again closed, latch 74 may be moved slidingly to the left of the illustration of FIG. 6 and rotated out of latch housing 73 so as to disengage its contact with latch hook 19. Springs 20 will then withdraw chains 18 and latch hook 19 back within lock body 11 and the door may be opened to permit entry and egress therethrough.

What has been disclosed is a dead bolt lock which houses both a dead bolt and a security chain assembly. Externally accessible drive linkages cause the simultaneous ejection of the dead bolt and a portion of the security chain assembly whereby the dead bolt is engaged with a strike plate in the door jamb and the security chain assembly is latched to a chain latch assembly which forms a part of the strike plate. Operation of the externally accessible drive linkage to withdraw the dead bolt back into the lock is acheived without disengagement of the security chain assembly from the jamb mounted latch. A separate latch release is provided for disengaging the security chain. The lock body is provided with door penetrating detents which are actuated by the insertion of the dead bolt within the lock body whereby the detents are raised from within the lock body so as to lockingly engage with the door. No exterior screw fastenings are available to be tampered with, the lock body is enclosed within the door by the combination of exterior and interior plates and a latch plate. The door itself forms the remaining sides of the enclosure.

Those skilled in the art will conceive of other embodiments of the invention which may be drawn from the teachings herein. To the extent that such other embodiments are so drawn, it is intended that they shall fall within the ambit of protection of the claims appended hereto.

Having disclosed my invention in the foregoing specification and the accompanying drawings in such clear and concise manner that those skilled in the art may readily understand and easily practice the invention, that which I claim is:

1. A dead bolt lock having an internally housed security chain simultaneously ejected with the dead bolt comprising:

a dead bolt lock having a dead bolt and a self-retracting security chain assembly housed therein, said self-retracting security chain assembly having means for retraction of said self-retracting security chain assembly into said dead bolt lock;

security chain drive linkage means coupled to said security chain assembly for partially ejecting a portion of said security chain assembly from said dead bolt lock; and externally accessible drive means coupled to said security drive linkage means and to said dead bolt for simultaneously ejecting a portion of said dead bolt and a portion of said security chain assembly from said dead bolt lock.

2. The deadbolt lock of claim 1 further comprising in combination therewith, chain latch means adjacent said dead bolt lock for restrainedly latching a portion of said security chain assembly ejected from said dead bolt lock by actuation of said externally accessible drive means, said chain latch means being installed within a door jamb adjacent said dead bolt lock when said lock is installed in a door.

3. The dead bolt of claim 2 wherein said chain latch means further comprises a strike plate coupled thereto and a latch housing recessed within said strike plate and pivotally coupled thereto.

4. The deadbolt lock of claim 3 wherein said chain latch means is installed within a door jamb and said strike plate further comprises means for coupling said strike plate to said door jamb, said coupling means mating orthogonally within said door jamb in which said chain latch means is installed to thereby retain said chain latch means within said door jamb.

5. In a dead bolt lock comprising a lock body having dead bolt means therein, a lock housing housing said lock body and coupling same within a door to be secured, and means coupled to said dead bolt means for exercising said dead bolt means so as to eject and retract said dead bolt means from said lock body, the improvement comprising:

a security chain assembly coupled to said lock body and housed within said lock housing for mounting within said door with said lock body; and security chain ejection means released coupled to said security chain assembly and coupled to said means for exercising said dead bolt means for simultaneously ejecting both said dead bolt means and a aportion of said security chain assembly from said lock housing when said means for exercising said dead bolt means is operated to eject said dead bolt means from said lock body.

6. The deadbolt lock of claim 5 further comprising in combination therewith, chain latch means adjacent said dead bolt lock for restrainedly latching a portion of said security chain assembly ejected from said dead bolt lock by actuation of said externally accessible drive means, said chain latch means being installed within a door jamb adjacent said dead bolt lock when said lock is installed in a door.

7. The improvement of claim 6 wherein said chain latch means further comprises a strike plate coupled thereto and a latch housing recessed within said strike plate and pivotally coupled thereto.

8. The deadbolt lock of claim 7 wherein said chain latch means is installed within a door jamb and said strike plate further comprises means for coupling said strike plate to said door jamb, said coupling means mating orthogonally with said door jamb in which said chain latch means is installed to thereby retain said chain latch means within saud door jamb.

9. The improvement of claim 5 wherein said security chain assembly comprises:

a security chain;

a latch hook coupled to a first end of said security chain; and retraction means coupled to a second end of said security chain for retaining a retracting tension on said security chain.

10. The improvement of claim 9 wherein said retraction means comprises:

spring means having a first end coupled to said lock body; and retraction linkage means coupling a second end of said spring means to said second end of said security chain.

11. The improvement of claim 10 wherein said retraction linkage means further comprises a stop pawl coupled to said security chain and wherein said lock body and lock housing further comprise stop pawl guideways for guiding and positively limiting the extent of travel of said stop pawl and thus limiting the extent of egress of said security chain from said lock housing.

12. The improvement of claim 11 further comprising, in combination therewith, chain latch means for latchedly engaging and retaining a portion of said security chain assembly ejected from said dead bolt lock by actuation of said means for exercising said dead bolt means, said chain latch means being installable within a door jamb adjacent said dead bolt lock when said lock is installed in a door.

13. The improvement of claim 12 wherein said chain latch means further comprises a strike plate and a latch housing recessed within said strike plate and pivotally coupled thereto.

14. The deadbolt lock of claim 13 wherein said chain latch means is installed within a door jamb and said strike plate further comprises means for coupling said strike plate to said door jamb, said coupling means mating orthogonally within said door jamb in which said chain latch means is installed to thereby retain said chain latch means within said door jamb.

* * * * *